US006385325B1

(12) United States Patent
Nageno et al.

(10) Patent No.: US 6,385,325 B1
(45) Date of Patent: May 7, 2002

(54) HEADPHONE DEVICE

(75) Inventors: Koji Nageno, Tokyo; Tomohiro Ito, Kanagawa, both of (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/415,208

(22) Filed: Oct. 12, 1999

(30) Foreign Application Priority Data

Oct. 16, 1998 (JP) ..... 10-295938

(51) Int. Cl.[7] ..... H04R 25/00

(52) U.S. Cl. ..... 381/374; 381/370; 381/378; 381/381; 381/383

(58) Field of Search ..... 381/182, 330, 381/370, 371, 374, 376, 378, 379, 381, FOR 149, FOR 150; 379/430

(56) References Cited

U.S. PATENT DOCUMENTS 454,138 A * 6/1891 Mercadier ..... 381/370
1,699,127 A * 1/1929 Wacker ..... 381/378
4,409,442 A * 10/1983 Kamimura ..... 381/383

* cited by examiner

*Primary Examiner*—Stella Woo
*Assistant Examiner*—Suhan Ni
(74) *Attorney, Agent, or Firm*—Jay H. Maioli

(57) ABSTRACT

A headphone device includes first and second head band members, a first fulcrum portion for pivotally supporting top ends of the first and second head band members so that the lower ends of the first and second head band members are moved towards and away from each other, first and second speaker unit supporting members carrying first and second speaker units, and second and third fulcrum portions for pivotally supporting the respective ends of the first and second speaker unit supporting members for rotation towards the lower ends of the first and second head band members. The center axes of rotation of the second and third fulcrum portions extend in a direction substantially perpendicular to the center axis of rotation of the first fulcrum portion. The headphone device also includes ear support portions provided on the first and second speaker unit supporting members that are retained between the head and the auricles of the user when the user attaches the headphone device to the head.

4 Claims, 10 Drawing Sheets

HEADPHONE DEVICE

BACKGROUND OF THE INVENTION

1. Field of the Invention

This invention relates to a headphone device attached to the user's head in which a speaker unit is supported on a head band attached to the user's head. More particularly, it relates to a collapsible headphone device.

2. Description of the Related Art

Among headphone devices, attached to the user's head in use, there is a collapsible type device in which a first speaker unit on the left side and a second speaker unit on the right side, paired to the left-side speaker unit, are supported via first and second head band supporting members , which are rotatably interconnected via a fulcrum portion in order to render the device collapsible.

There is also such a collapsible type device in which the first and second headband members are collapsibly interconnected and in which first and second speaker unit supporting members carrying the first and second speaker units are rotatably connected to the first and second head band members via a fulcrum portion in order to render the first and second speaker unit supporting members collapsible with respect to the first and second head band members to realize the smaller size of the device.

In a conventional or previously proposed collapsible headphone device, only the first and second head band members are collapsible, while first and second speaker unit supporting members are collapsible with respect to the first and second head band members, such that optimum attachment feeling is not obtained.

In another conventional or previously proposed collapsible headphone device, connection cords are drawn out from the first and second speaker units loaded on left and right auricles so as to be interconnected and unified together partway, and connection plugs are mounted on the distal ends of the unified connection cords.

In the headphone device in which the connection cords are drawn out from the first and second speaker units and interconnected halfway, the connection cords cannot be wound efficiently when the device is collapsed. Moreover, when the device is attached to the head, the connection cords are drawn out from both sides of the head, so that the connection cords become obstructive, such that optimum attachment feeling again is not obtained.

In the headphone device, in which the connection cords are drawn out from the first and second speaker units, the first and second head band members and the connection cords are arranged in ring shape, so that the device needs to be attached with the user's head in a loop of the ring shape of the connection cords to render the attachment operation difficult. In particular, in a headphone device in which the first and second head band members are attached to the rear portion of the user's head, the device needs to be attached with the user's head completely within the loop of the ring shape of the user to increase the difficulties in attachment operations.

SUMMARY OF THE INVENTION

It is therefore an object of the present invention to provide a collapsible headphone device which is able to impart an optimum attachment feeling.

It is another object of the present invention to provide a collapsible headphone device in which the device is collapsed as an ear support portion responsible for realizing an optimum attachment feeling and is reliably protected so that it is possible to prevent damage during the time the device is carried around or transported.

It is yet another object of the present invention to provide a headphone device which can be collapsed easily and in which the connection cords drawn out from the speaker unit can be protected reliably.

In one aspect, the present invention provides a headphone device a headphone device including first and second head band members, a first fulcrum portion for pivotally supporting top end of the first and second head band members so that the lower end of the first and second head band members are moved towards and away from each other, first and second speaker unit supporting members carrying first and second speaker units at one end thereof, second and third fulcrum portions for pivotally supporting the other ends of the first and second speaker unit supporting members for rotation towards the other ends of the first and second head band members, and ear support portions provided on the first and second speaker unit supporting members so as to be retained between the head and the auricles of the user when the user attaches the headphone device to the head. The center axes of rotation of the second and third fulcrum portions extend in a direction substantially perpendicular to the center axis of rotation of the first fulcrum portion When attached to the head, the headphone device is retained in a stable state by the ear support portions provided on the first and second speaker unit supporting members being retained between the head and the auricles. The attachment feeling may be optimized by having the ear support portions formed of a soft elastic material.

The first and second speaker units are mounted on one end of the first and second speaker unit supporting members so that the sound radiating surfaces thereof face each other, and the ear support portions are provided on the first and second speaker unit supporting members for facing the sound radiating surfaces of the first and second speaker units. This enables the headphone device to be attached so that the auricle will be clamped between the speaker unit and the ear support portion, thus assuring stabilized attachment state.

In another aspect, the present invention provides a headphone device a headphone device including first and second head band members, a first fulcrum portion for pivotally supporting top end of the first and second head band members so that the lower end of the first and second head band members are moved towards and away from each other, first and second speaker unit supporting members carrying first and second speaker units at one end thereof, second and third fulcrum portions for pivotally supporting the other end of the first and second speaker unit supporting members for rotation towards the lower end of the first and second head band members, the second and third fulcrum portions having center axes of rotation extending in a direction substantially perpendicular to the center axis of rotation of the first fulcrum portion, and ear support portions provided on the first and second speaker unit supporting members so as to be retained between the head and the auricles of the user when the user attaches the headphone device to the head. The ear support portions are housed in an area between the first and second speaker unit supporting members and the first and second head band members when the first and second speaker unit supporting members are collapsed towards the first and second head band members about the second and third fulcrum portions as the center of rotation and the first and second head band members are collapsed about the first fulcrum portion as the center in a direction in which the other ends thereof approach each other. This protects the ear support portions formed of a soft elastic material.

In yet another aspect, the present invention provides a headphone device headphone device including first and second head band members, a first fulcrum portion for pivotally supporting top end of the first and second head band members so that the lower end of the first and second head band members are moved towards and away from each other, first and second speaker unit supporting members carrying first and second speaker units at one end thereof, second and third fulcrum portions for pivotally supporting the other end of the first and second speaker unit supporting members for rotation towards the lower end of the first and second head band members, the second and third fulcrum portions having center axes of rotation extending in a direction substantially perpendicular to the center axis of rotation of the first fulcrum portion, and a connection cord pulled out from one of the first and second speaker units, inserted from one of the first and second speaker units into the first and second head band members, inserted into the other of the first and second speaker unit supporting members and pulled out from the other of the first and second speaker unit supporting members. The connection cord having an excess portion on an outer rim side of the direction of rotation of the first and second speaker unit supporting members towards the first and second head band members about the center axis of rotation of the second and third fulcrum portions as center of rotation.

Since the connection cord has the excess length portion, the path difference of the connection cord, produced by rotation of the first and second speaker unit supporting members and the first and second head band members, can be taken up to assure stable rotation and facilitated collapsing.

DESCRIPTION OF THE PREFERRED EMBODIMENTS

Figure 1:
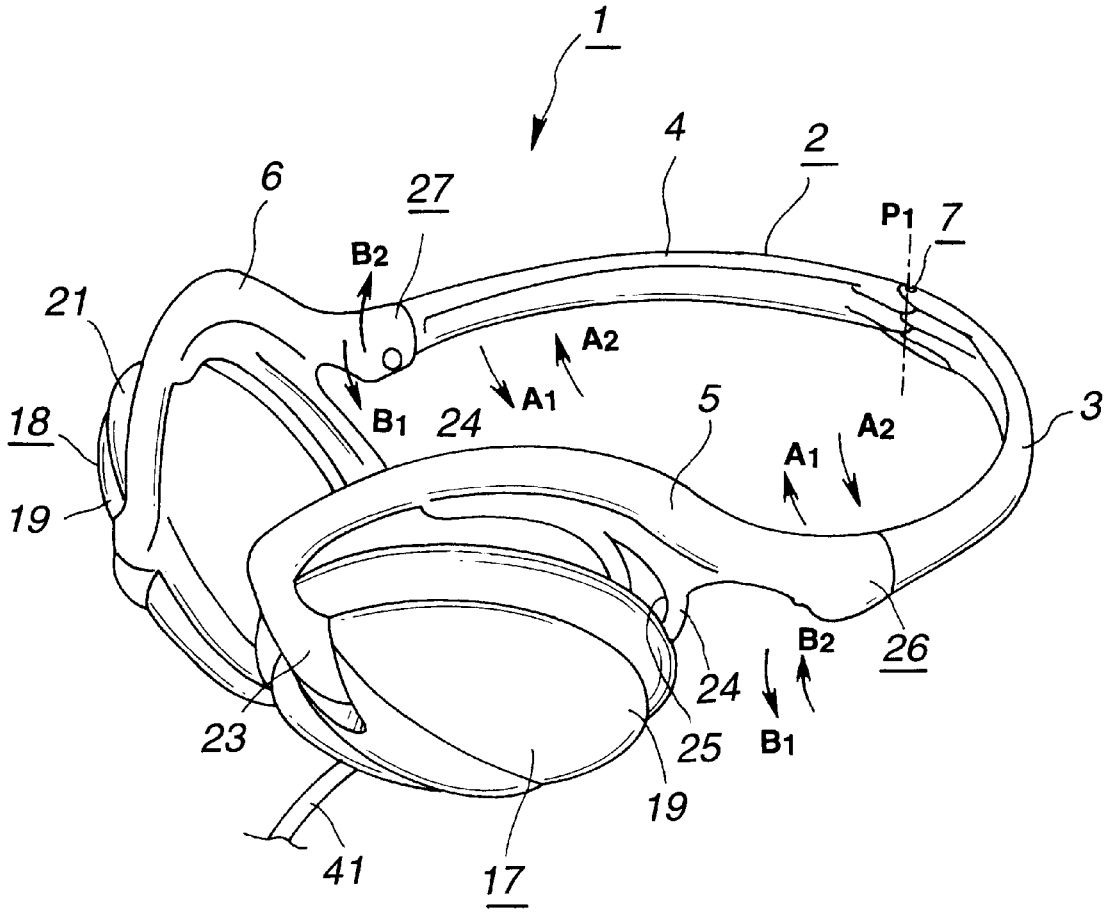
FIG. 1 is a perspective view of a headphone device according to the present invention.

Referring to the drawings, preferred embodiments of the image generating method and apparatus according to the present invention will be explained in detail.

Figure 2:
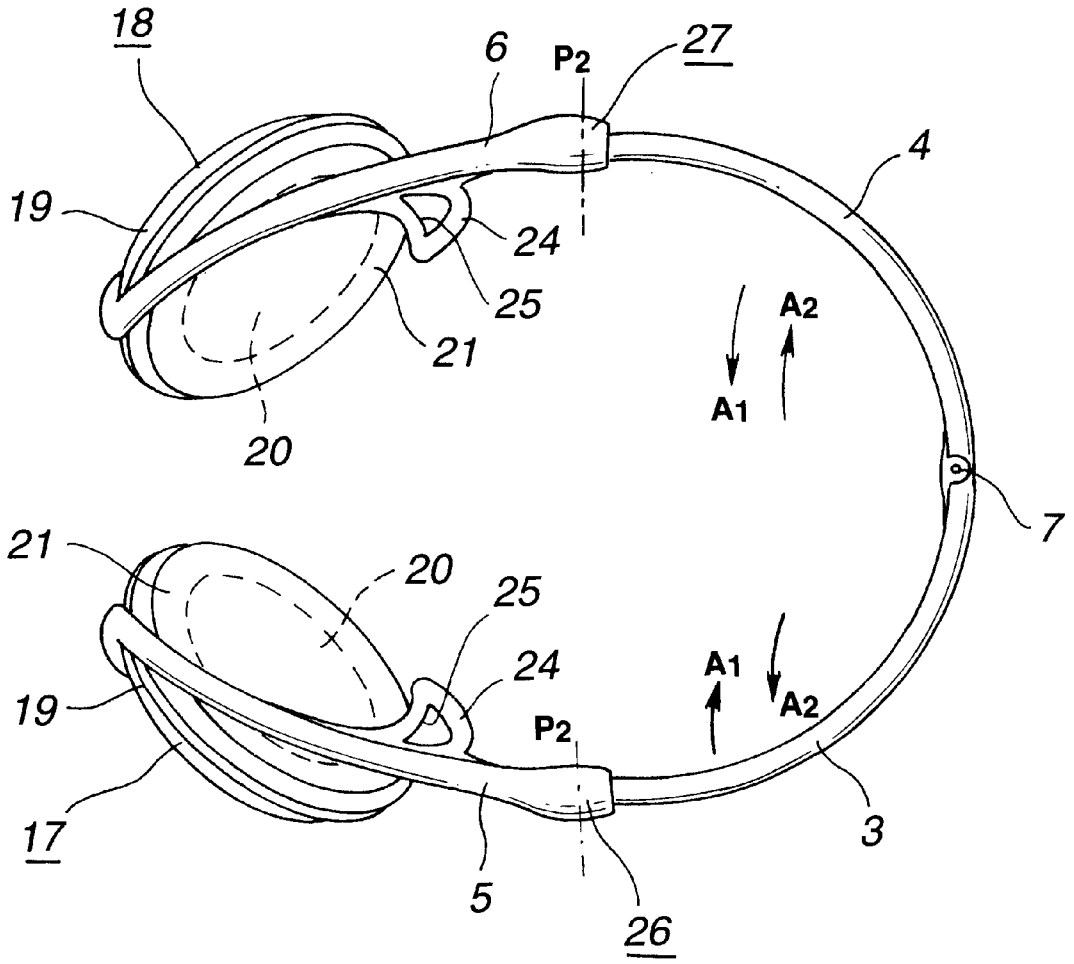
FIG. 2 is a plan view of the headphone device.

Referring to FIGS. 1 and 2, a headphone device 1 according to the present invention includes first and second headband members 3, 4 interconnected to constitute a hemi-circularly bent head band 2 for attachment to the rear portion of the user's head. These first and second headband members 3, 4 are of a pre-set width to permit the headphone device 1 to be attached in a stable state to the user's head with an optimum attachment feeling, and are bent to form a portion of the hemi-circular head band 2. The first and second headband members 3, 4 are formed of synthetic resin, such as polypropylene or polybutylene terephthalate or corrosion-resistant metal.

Figure 3:
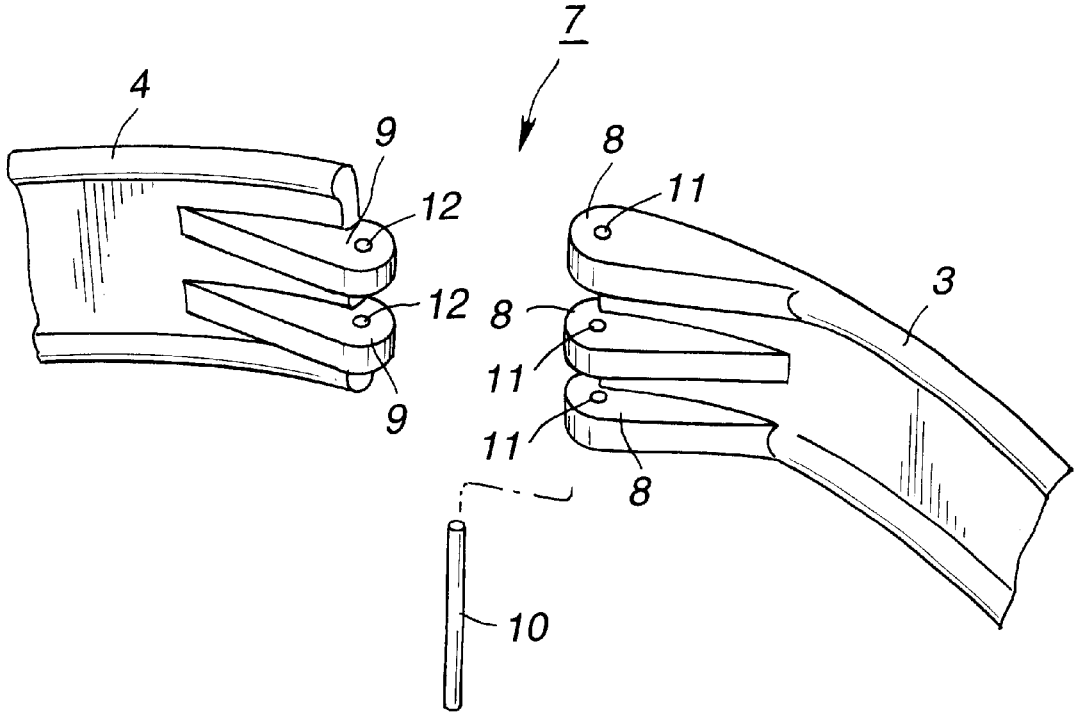
FIG. 3 is an exploded perspective view showing a first fulcrum portion interconnecting first and second headband members.
Figure 4:
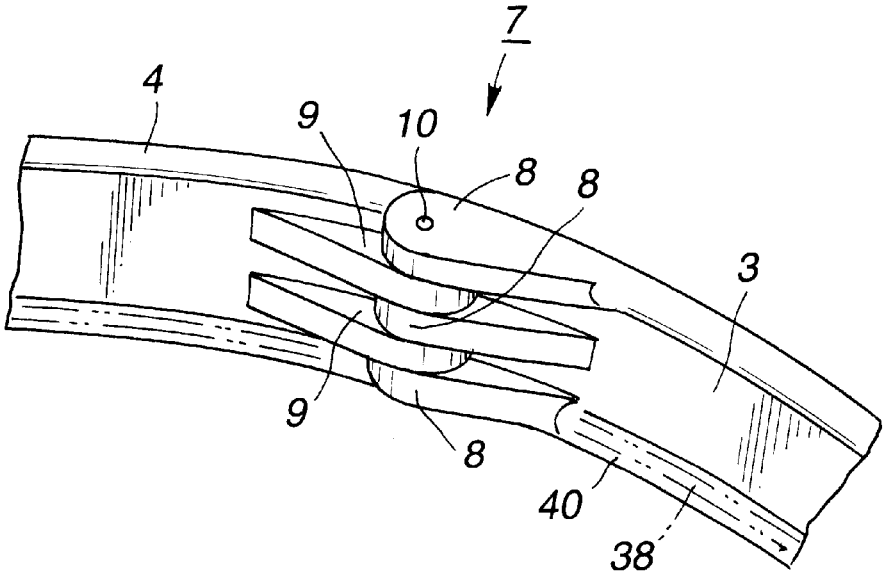
FIG. 4 is a perspective view showing the state of interconnection of the first and second headband members.

In order to permit the lower ends of first and second headband members 3, 4, that are connected to first and second speaker unit supporting members 5, 6, to be moved towards and away from each other, the top end of the first and second headband members 3, 4 are rotatably interconnected via a first fulcrum portion 7. The first fulcrum portion 7 includes plural engagement pieces 8, 9, protuberantly formed on the above-mentioned top end of the first and second headband members 3, 4, respectively, so as to be interengaged together, and a pivot shaft 10 interconnecting the engagement pieces 8, 9, as shown in FIG. 3. These engagement pieces 8, 9 are protuberantly formed from the curved inner peripheral surfaces of the first and second headband members 3, 4 at a pre-set spacing and parallel to each other so that the engagement pieces 8 of the first head band member 3 are interengaged with the engagement pieces 9 of the second head band member 4. The engagement pieces 8, 9 are formed with through-holes 11, 12, respectively, which are in register with one another when the engagement pieces 8, 9 are combined together, as shown in FIG. 4. The first and second headband members 3, 4 are interconnected by interengaging the engagement pieces 8, 9 and by passing the pivot shaft 10 through the through-holes 11, 12, and are rotatably supported in the direction indicated by arrows A1 and A2 in FIGS. 1 and 2 in which the top end of the first and second headband members 3, 4 are drawn close to or separated away from each other with the pivot shaft 10 as center.

Figure 5:
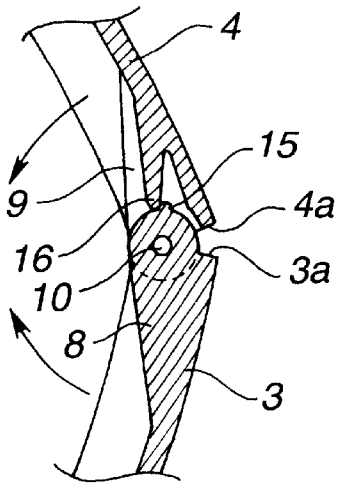
FIG. 5 is a cross-sectional view showing a first fulcrum portion interconnecting the first and second headband members.

On a curved outer rim of the above-mentioned other end of the first head band member 3, there is formed a retention shoulder 3*a* to which is abutted an end face 4*a* on a curved outer rim of the above-mentioned other end of the second head band member 4, as shown in FIG. 5. When the first and second headband members 3, 4 are rotated in the opening direction in which the above-mentioned one ends are separated from each other in the direction indicated by arrow A2 in FIGS. 1 and 2, with the pivot shaft 10 as center of rotation, the end face 4*a* on the opposite side of the second head band member 4 is abutted against and retained by the retention shoulder 3*a* of the first head band member 3 to control the rotational position to constitute the head band 2 which is continuously curved so as to be attached to the rear head portion.

The peripheral surface of the engagement piece 8 provided on the first head band member 3 is formed with a retention lug 15, as shown in FIG. 5, while an elastic piece 16 adapted to have a sliding contact with the peripheral surface of the engagement piece 8 is formed on the second head band member 4, to permit intermittent rotation of the first and second headband members 3, 4 to maintain the rotary position of the first and second headband members 3, 4 in which the headphone device can be loaded on the rear head portion, as shown in FIGS. 1 and 2, thus assuring stabilized attachment of the headphone device on the rear head portion.

On the top end of the first and second headband members 3, 4, rotationally interconnected via the first fulcrum portion 7 as described above, there are rotatably connected the first and second speaker unit supporting members 5, 6, respectively. Similarly to the first and second headband members 3, 4, the first and second speaker unit supporting members 5, 6 are formed of synthetic resin, such as polypropylene or polybutylene terephthalate, or corrosion-resistant metal.

On one end of first speaker unit supporting member 5, there is supported a first speaker unit 17 for left channel, whereas, on an end of the second speaker unit supporting member 6, there is supported a second speaker unit 18 for right channel.

The first and second speaker units 17, 18, supported by the first and second speaker unit supporting members 5, 6, respectively, are each comprised of a circular housing 19, within which is housed a speaker 20, as shown in FIGS. 1 and 2. On an abutting surface of the housing 19 to the auricle, representing a sound radiating surface, there is mounted an ear pad 21, formed of a flexible material, such as foamed polyurethane, in order to optimize the attachment feeling to the auricle.

Figure 6:
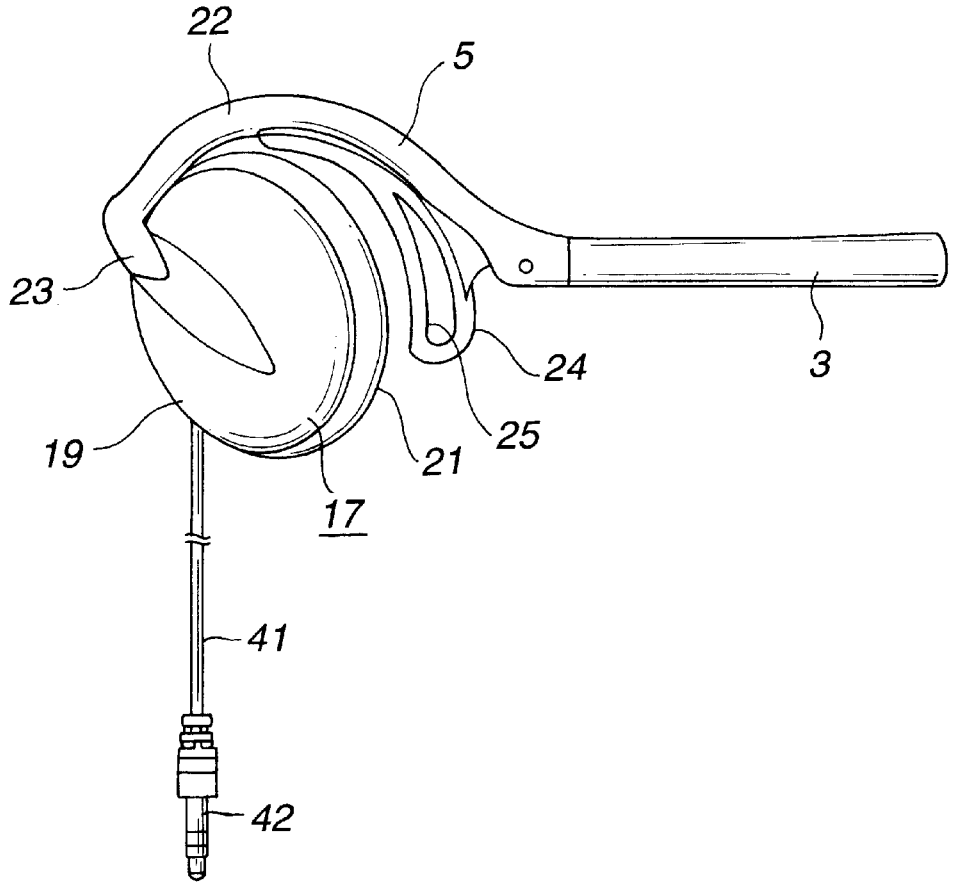
FIG. 6 is a side view of the headphone device according to the present invention.

The first and second speaker unit supporting members 5, 6, supporting the first and second speaker units 17, 18, are formed symmetrically in the left-and-right direction. Therefore, only the first speaker unit 17 is now explained. The first speaker unit supporting member 5 has its mid portion bent to form a bent portion 22 for surrounding the outer peripheral side of the circular first speaker unit 17 supported on one end of the first speaker unit supporting member 5. On one end of the bent portion 22 is mounted the speaker supporting portion 23 bent towards the bent portion 22. Referring to FIG. 6, the first speaker unit 17 is supported by the first speaker unit supporting member 5 by having the distal end of the speaker supporting portion 23 secured to an outer rim portion on its back side opposite to its sound radiating side so that its outer periphery is surrounded by the bent portion 22. The speaker supporting portion 23 is bent so that, when its distal end is secured to the first speaker unit 17, the bent portion 22 is located on the sound radiating side of the first speaker unit 17.

The inner rim of the bent portion 22 of the first speaker unit supporting member 5 is provided with an ear support portion 24 retained between the user's head and the user's auricle when the headphone device 1 is loaded on the user's head as will be explained subsequently. This ear support portion 24 is formed as one with the inner rim of the bent portion 22 such as to face the sound radiating side of the first speaker unit 17. The ear support portion 24 is formed of a soft elastic material, such as silicone rubber, and is curved to follow the contour of the outer rim of the auricle, as shown in FIG. 6. The ear support portion 24 is formed with a through-hole 25 to improve its softness and to enable it to be retained between the head and the auricle with an optimum attachment feeling.

The first and second speaker unit supporting members 5, 6, carrying the first and second speaker units 17, 18 at one end thereof, respectively, are rotatably supported at the other end thereof via second and third fulcrum portions 26,27 by the lower end of the first and second headband members 3, 4, respectively.

Figure 7:
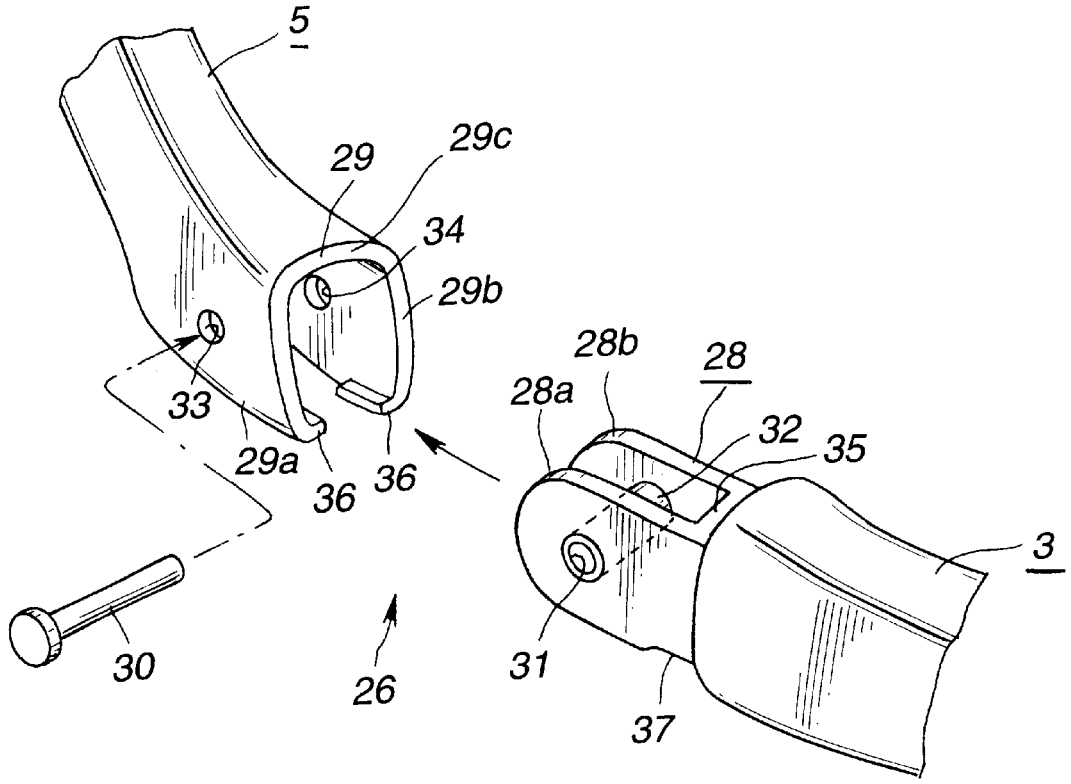
FIG. 7 is an exploded perspective view showing a second fulcrum portion interconnecting the first headband member and a first speaker unit supporting member.

Since the second and third fulcrum portions 26, 27 are of the same structure, only the second fulcrum portion 26 is explained in detail. Referring to FIG. 7, the second fulcrum portion 26 includes a rotation supporting member 28, substantially in the form of a flat plate, formed at one end of the first head band member 3, and a fitting portion 29, with a U-shaped cross-section, formed at the other end of the first speaker unit supporting member 5 and into which fits the rotation supporting member 28. The rotation supporting member 28 is made up of a pair of rotary pieces 28*a*, 28*b* protruded parallel to each other from one end of the first head band member 3 and a shaft inserting member 32 carrying a center through-hole 31 passed through by a pivot shaft 30 for interconnecting the rotary pieces 28*a*, 28*b*. The rotation supporting member 28, in its entirety, is in the form of a yarn take-up bobbin. The gap lying around the shaft inserting member 32 between the rotary pieces 28*a*, 28*b* serves as an inserting portion for a connection cord which will be explained subsequently. The fitting portion 29 is U-shaped with a width sufficient to permit the rotation supporting member 28 to fit therein with a pressure contact with respect to the rotation supporting member 28. In facing lateral wall sections 29*a*, 29*b* are formed a shaft inserting hole 33 and a tapped hole 34 passed through by a supporting shaft 30 which then is passed through the through-hole 31.

Figure 8:
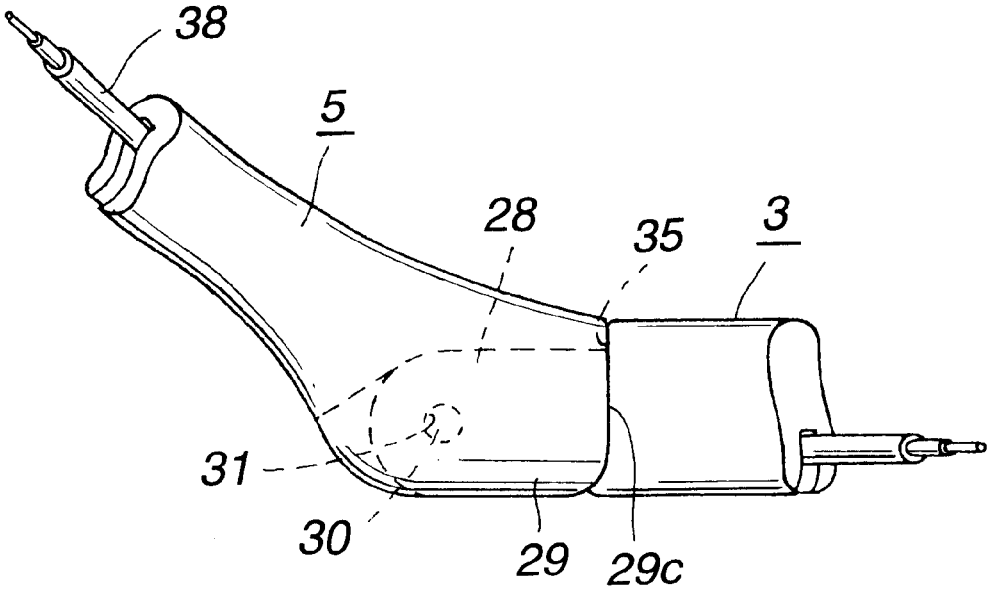
FIG. 8 is a partial side view showing the first headband member and the first speaker unit supporting member interconnected via the second fulcrum member.
Figure 9:
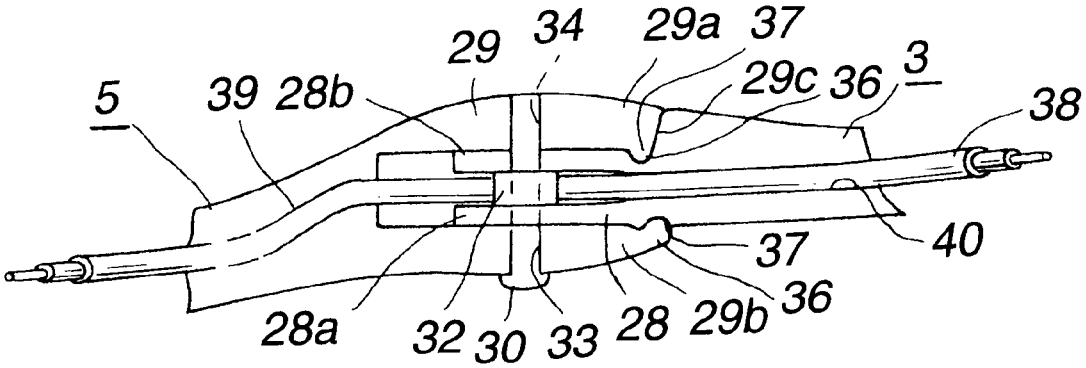
FIG. 9 is a partial bottom plan view showing the first headband member and the first speaker unit supporting member interconnected via the second fulcrum member.

The first speaker unit supporting member 5 is connected to the first head band member 3, for rotation in the direction indicated by arrows B1 and B2 in FIG. 1, by fitting the rotation supporting member 28 provided on the first head band member 3 in the fitting portion 29 so that the through-hole 31 formed in the shaft inserting member 32 is aligned with the through-hole 33 and the tapped hole 34 formed in the fitting portion 29, and by introducing a screw-like pivot shaft 30 from the side of the through-hole 33 of the fitting portion 29 through the through-hole 31 in the shaft inserting member 32 into meshing with the tapped hole 34, as shown in FIGS. 8 and 9.

On the proximal end of the rotation supporting member 28, protuberantly formed on the other end of the first head band member 3, there is formed a retention shoulder 35 against which an end face 29*c* of the fitting portion 29 abuts when the first speaker unit supporting member 5 is rotated so as to be continuous to the first head band member 3. When the first speaker unit supporting member 5 is rotated about the pivot shaft 30 in the direction indicated by arrow B2 in FIG. 1 until the end face 29*c* of the fitting portion 29 compresses against the retention shoulder 35, the first speaker unit supporting member 5 is continuous to the first head band member 3, without interruptions, to inhibit further rotation in the direction indicated by arrow B2 in FIG. 1.

The lower edges on the opening sides of the sidewall sections 29*a*, 29*b*, making up the fitting portion 29, are formed with inwardly projecting retention lugs 36, 36. When the first speaker unit supporting member 5 is rotated about the rotation supporting member 28 as center, until it is continuous to the first head band supporting member 3, as shown in FIG. 2, these retention lugs 36 are interengaged with engagement recesses 37, 37 formed in the lower edges of the proximal sides of the rotary pieces 28*a*, 28*b* of the rotation supporting member 28, as shown in FIGS. 8 and 9, to inhibit free rotation of the first speaker unit supporting member 5 relative to the first head band member 3 to maintain the above-mentioned continuous condition.

The second and third fulcrum portions 26, 27 for rotatably connecting the first and second speaker unit supporting members 5, 6 to the first and second headband members 3, 4, respectively, are arranged so that center axes of rotation P2 thereof are substantially perpendicular to the center axis of rotation P1 of the first fulcrum portion 7 rotatably interconnecting the first and second headband members 3, 4, as shown in FIGS. 1 and 2. That is, the second and third fulcrum portions 26, 27 are provided so that the pivot shaft 30 will be perpendicular to the pivot shaft 10 of the first fulcrum portion 7.

By arranging the center axes of rotation P2 of the second and third fulcrum portions 26, 27 so as to be substantially perpendicular to the center axis of rotation P1 of the first fulcrum portion 7, the first and second speaker unit supporting members 5, 6 can be collapsed towards the first and second headband members 3, 4,which are collapsed on being rotated about the first fulcrum portion 7 as center of rotation, thus enabling the headphone device 1 to be collapsed to an extremely small size.

Meanwhile, in the headphone device 1 of the present invention, a connection cord 38, pulled out from the second speaker unit 18, is pulled outwards from the second speaker unit 18, via a cord insertion opening, not shown, provided on the housing 19, so as to be passed through a cord inserting groove 39 formed in the second speaker unit supporting member 6 supporting the second speaker unit 18. The connection cord 38 is then passed through a cord inserting groove 40 formed in the second head band member 4 through the length of the third fulcrum portion 27, then through the cord inserting groove 40 formed in the first head band member 3 through the length of the first fulcrum portion 7 and then through the cord inserting groove 39 provided in the first speaker unit supporting member 5 through, the length of the second fulcrum portion 26. The connection cord 38, passed through the first speaker unit supporting member 5, is pulled outwards from the distal end of the speaker supporting portion 23, and passed through the housing 19 via a cord insertion opening, not shown, provided in the housing 19 of the first speaker unit 17. The connection cord 38, inserted through the inside of the housing 19 of the first speaker unit 17, is connected in the housing 19 with an external connection cord 41, pulled out from the first speaker unit 17, so as to be unified with the external connection cord 41 and pulled outwards from the first speaker unit 17.

The distal end of the external connection cord 41 is fitted with a connection plug 42 adapted for connection to acoustic equipment, such as a disc player.

It is noted that the connection cord 38, inserted into the inside of the first and second speaker unit supporting members 5, 6 and the first and second headband members 3, 4 so as to be pulled outwards from the second speaker unit 18 towards the first speaker unit 17, is extended across the first and second speaker unit supporting members 5, 6 and the first and second headband members 3, 4, rotatably interconnected via the second and third fulcrum portions 26, 27, and across the first and second headband members 3, 4, rotatably interconnected via the first fulcrum portion 7, there is produced a gap in the path length from the second speaker unit 18 to the first speaker unit 17 when the first and second speaker unit supporting members 5, 6 are rotated with respect to the first and second headband members 3, 4 about the second and third fulcrum portions 26, 27 as the center of rotation and the first and second headband members 3, 4 are rotated about the first fulcrum portion 7 as the center of rotation. That is, with the headphone device 1 according to the present invention, the path length of the connection cord 38 from the second speaker unit 18 to the first speaker unit 17 when the first and second speaker unit supporting members 5, 6 are folded with respect to the first and second headband, members 3, 4 and the first and second headband members 3, 4 is also collapsed and differs from that when the headphone device 1 is extended for attachment to the user's head.

Thus, in order to cope with this variable path length from the second speaker unit 18 to the first speaker unit 17, the connection cord 38 has a length sufficient to run along the path of a maximum length which prevails when the first and second speaker unit supporting members 5, 6 and the first and second headband members 3, 4 are collapsed as described above. If the connection cord 38 is of a length to cope with the maximum length path as described above, there is produced a redundant length portion in the path from the second speaker unit 18 to the first speaker unit 17, such that the connection cord 38 becomes flexed or popped from the cord inserting groove 39 provided in the first and second speaker unit supporting members 5, 6 or from the cord inserting groove 40 provided in the first and second headband members 3, 4.

If the connection cord 38 is flexed, there arises the risk of line breakage. On the other hand, if the connection cord 38 is popped out from the cord inserting grooves 39, 40, it cannot be protected sufficiently such that elasticity of the connection cord 38 tends to be lost on application of the slightest impact or contact with an extraneous object.

Thus, the present headphone device 1 is designed so that surplus in the length of the cord inserting groove 39 produced with the path change is taken up at the second and third fulcrum portions 26, 27 rotationally supporting the first and second speaker unit supporting members 5, 6 with respect to the first and second headband members 3, 4.

That is, the connection cord 38 is endowed with an excess length on an outer side of the pivot shaft 30 for the second and third fulcrum portion 26 or 27 along the direction of rotation of the first and second speaker unit supporting member 5 or 6 towards the first and second headband member 3 or 4 about the pivot shaft 30 as the center of rotation.

Figure 10:
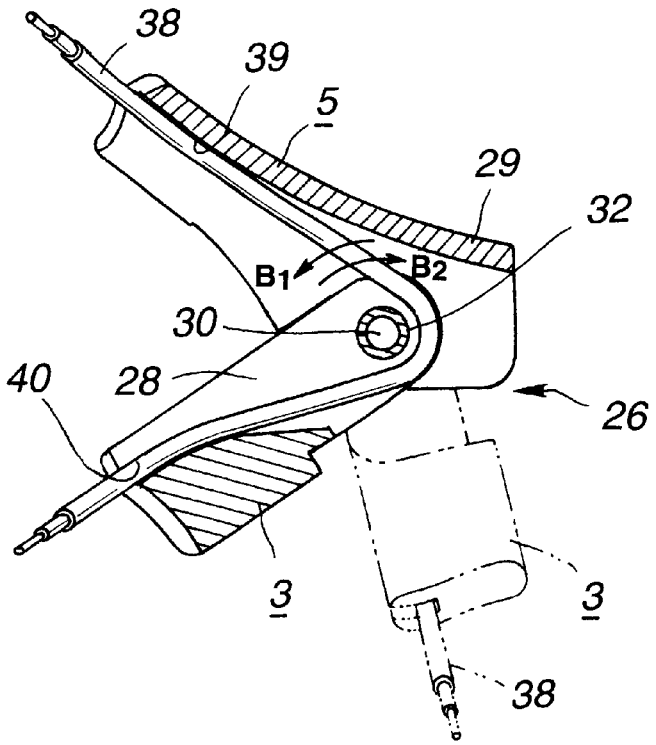
FIG. 10 is a cross-sectional view showing the first headband member and the first speaker unit supporting member interconnected via the second fulcrum member.
Figure 11:
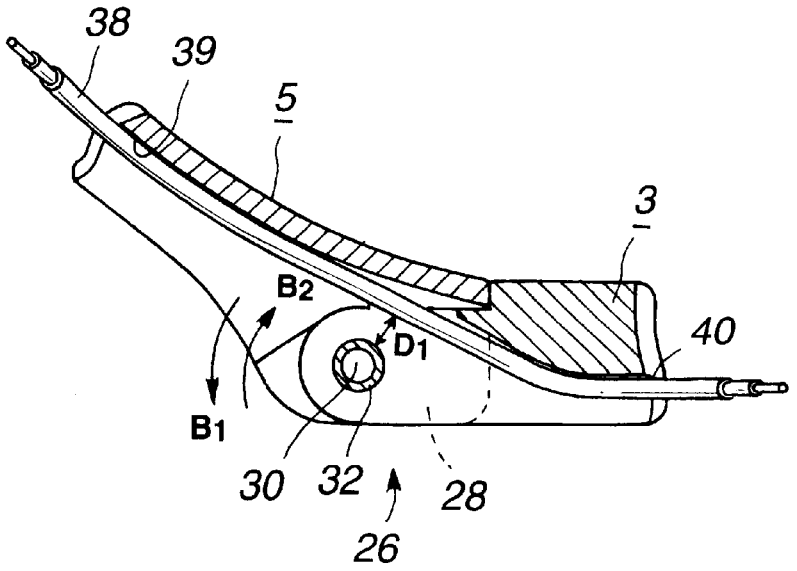
FIG. 11 is a cross-sectional view showing the state of collapsing the first speaker unit supporting member with respect to the first head band member.

Since the structure of providing an excess length of the connection cord 38 is similar for the second and third fulcrum portions 26, 27, the following description is made only on the second fulcrum portion 26 by referring to FIGS. 10 and 11. The connection cord 38 is endowed with an excess length such that, when the first speaker unit supporting member 5 is rotated in the direction indicated by arrow B2 in FIG. 10, about the pivot shaft 30 of the second fulcrum portion 26, so that the first speaker unit supporting member 5 is extended to form a continuum with respect to the first head band member 3, the connection cord 38 is extended at a spacing corresponding to a pre-set distance D1 from the pivot shaft 30 on the outer rim side along the direction of rotation of the first speaker unit supporting member 5 approaching to the first head band member 3 as indicated by arrow B1 in FIG. 10. Since the connection cord 38 is arranged for extending at a spacing D1 from the pivot shaft 30, the cord inserting groove 39 provided in the first speaker unit supporting member 5 and the cord inserting groove 40 provided in the first head band member 3 are formed to a depth sufficient to permit the connection cord 38 to be extended at a site spaced by the pre-set length D1 from the pivot shaft 30. The shaft inserting member 32 passed through by the pivot shaft 30 is provided in mid portions of the rotary pieces 28*a*, 28*b*.

Since the connection cord 38 has an excess portion on the outer side of the pivot shaft 30, the connection cord 38 is moved as it becomes flexed in the spacing of the pre-set distance D1 from the pivot shaft 30, as shown in FIG. 11, when the first speaker unit supporting member 5 is rotated in the direction of approaching the first head band member 3 as indicated by arrow B1 in FIG. 10, about the pivot shaft 30 of the second fulcrum portion 26 as the center of rotation, or when the first head band member 3 is rotated in the direction of approaching the first speaker unit supporting member 5 as indicated by arrow B2 in FIG. 10. This takes up the path length variation of the path from the second speaker unit 18 to the first speaker unit 17 to prevent flexing of the connection cord 38 en route from the second speaker unit 18 to the first speaker unit 17 as well as to prevent popping out of the connection cord 38 from the cord inserting groove 39 provided in the first or second speaker unit supporting member 5, 6 or out of the cord inserting groove 40 provided in the first or second headband member 3, 4.

Since the connection cord 38 is formed by coating a synthetic resin material on the metal conductors, and hence exhibits certain elastic recoiling force when flexed, the connection cord 38 elastically restores its former state when the first speaker unit supporting member 5 is rotated in the direction indicated by arrow B2 in FIG. 10 about the pivot shaft 30 of the second fulcrum portion 26 as the center of rotation and is thereby extended to form a continuum with the first head band member 3, so that the connection cord 38 is elastically reset to the position extending at the spacing D1 from the pivot shaft 30, as shown in FIG. 11.

Meanwhile, in the first fulcrum portion 7, the connection cord 38 is extended, without being endowed with an excess portion, between the first and second headband members 3, 4 along the pivot shaft 10 operating as the center of rotation of the first fulcrum portion 7.

When the headphone device 1, constructed as described above, is to be attached to the head of the user, the first and second speaker unit supporting members 5, 6 are rotated in the direction indicated by arrow B2 in FIG. 1, about the second and third fulcrum portions 26, 27 as the center of rotation, so as to form a continuum with respect to the first and second headband members 3, 4. The first and second headband members 3, 4 are also rotated about the first fulcrum portion 7 as the center of rotation in the direction indicated by arrow A2 in FIG. 1, in order that the first and second headband members 3, 4 will also form a continuum to each other.

Figure 12:
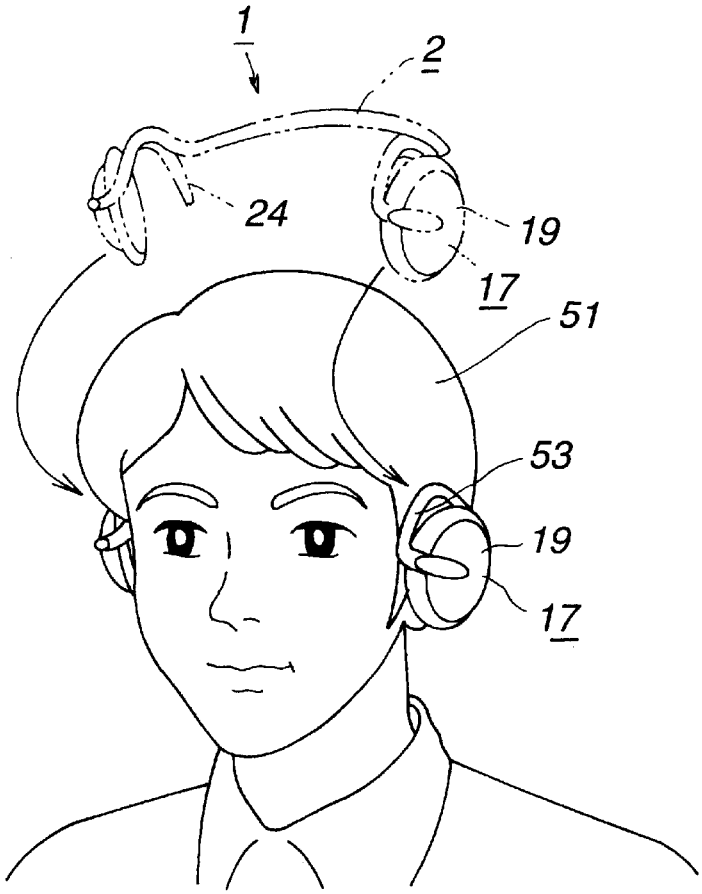
FIG. 12 is a perspective view showing the state of attaching the headphone device of the present invention to the user's head.
Figure 13:
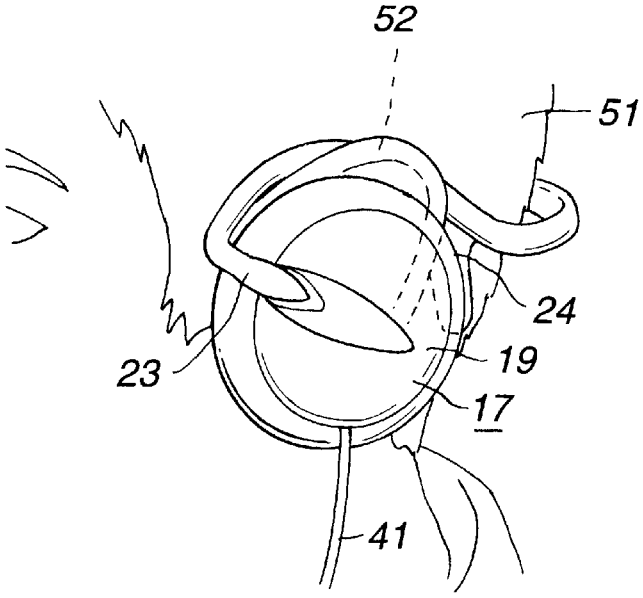
FIG. 13 is a perspective view showing the state in which the first and second speaker units are attached to the auricles.

When the first and second speaker unit supporting members 5, 6 and the first and second headband members 3, 4 have been extended as shown in FIGS. 1 and 2, the headphone device 1 is attached to the user's head so that the head band 2 will be on the rear head portion, as shown in FIG. 12. The first and second speaker units 17, 18 are attached to left and right auricles 52. The ear support portions 24, provided on the inner rims of the bent portions 22 of the first and second speaker unit supporting members 5, 6, are retained between the head 51 and the auricles 52, as shown in FIG. 13. Since the ear support portions 24 are mounted facing the sound radiating surfaces of the first and second speaker units 17, 18, the ear support portions 24 grip the auricles 52 in cooperation with the first and second speaker units 17, 18 to realize a more stable attachment condition.

Moreover, the ear support portions 24 are formed of an elastic material, such as soft silicone rubber, and hence give rise to an optimum attachment feeling.

When the headphone device 1 of the present invention is dismounted from the head for transporting or storage, it may be reduced in size by collapsing the first and second speaker unit supporting members 5, 6 and the first and second headband members 3, 4.

Figure 14:
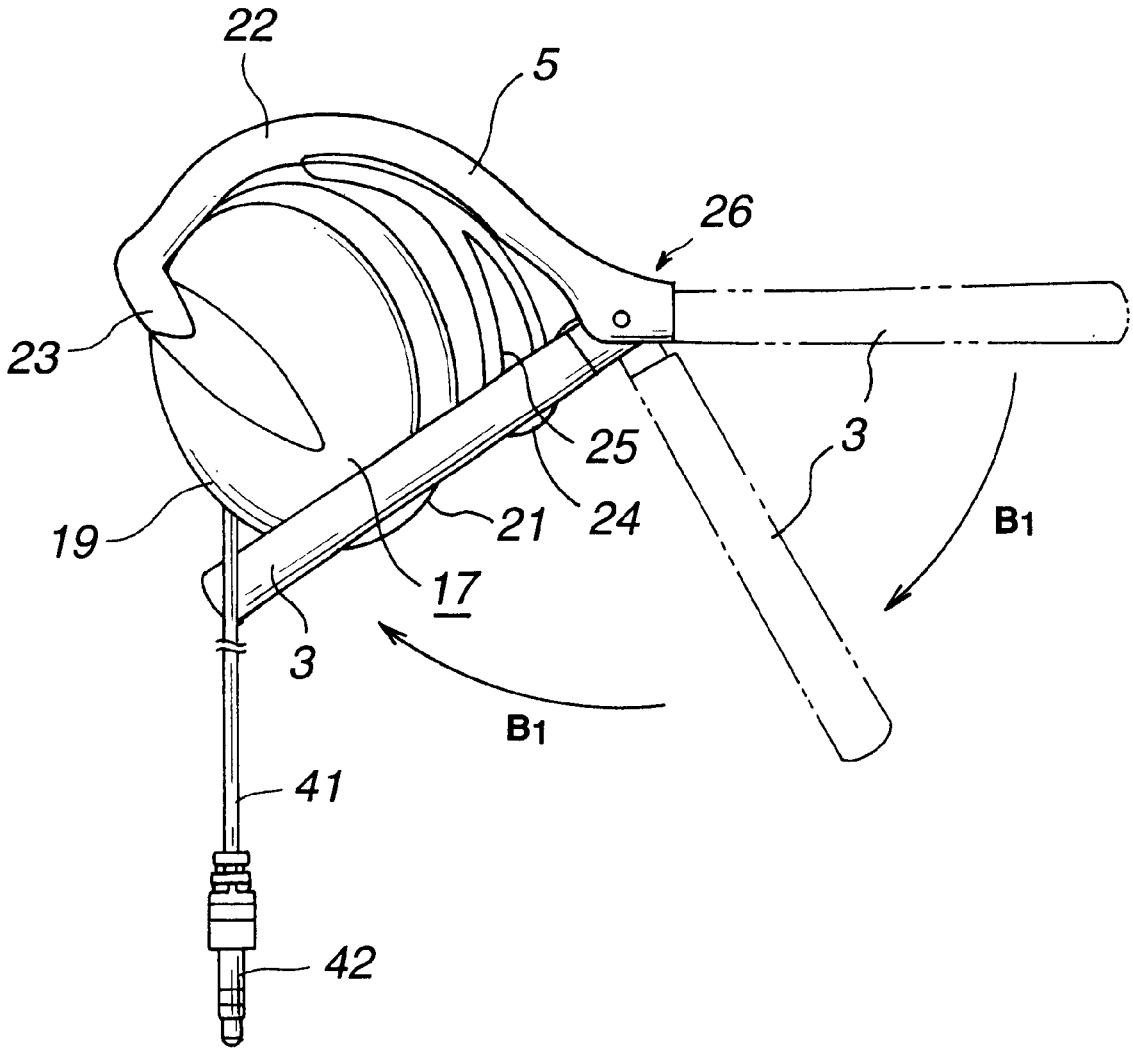
FIG. 14 is a side view showing the collapsed state of the first and second speaker units.
Figure 15:
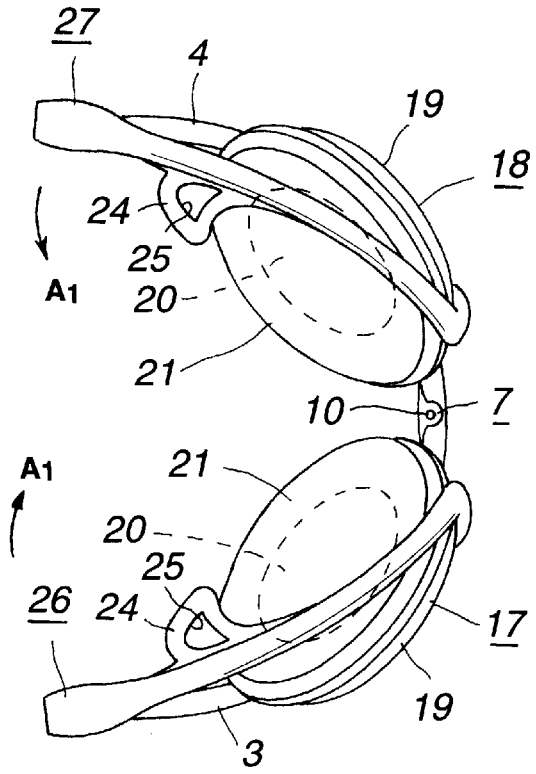
FIG. 15 is a side view showing the collapsed state of the first and second speaker units.

For collapsing the headphone device 1 according to the present invention, the first and second speaker unit supporting members 5, 6 are rotated in the direction indicated by arrow B1 in FIGS. 14 and 15, about the second and third fulcrum portions 26, 27 as center, to approach towards the first and second headband members 3, 4. The first and second headband members 3, 4 then are rotated in the direction indicated by arrow A1 in FIG. 15, that is in a direction perpendicular to the direction of rotation of the first and second speaker unit supporting members 5, 6 so that the lower end thereof will approach each other, thus collapsing the headphone device 1 to a compact size.

Figure 16:
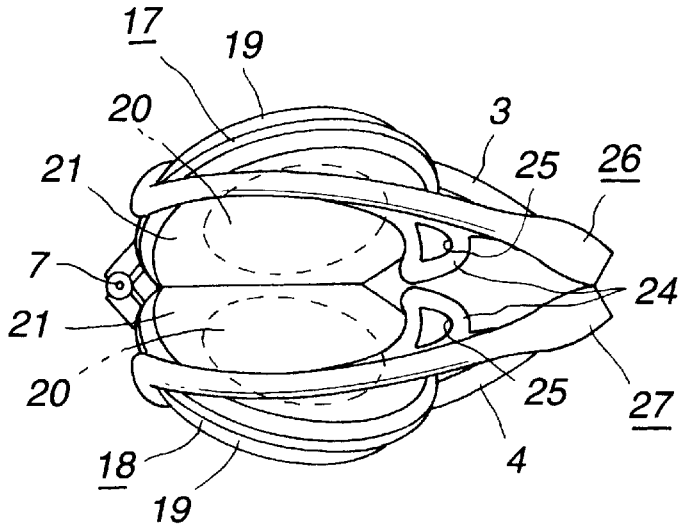
FIG. 16 is a plan view showing the collapsed state of the first and second speaker units and the first and second headband members.

At this time, the ear support portions 24, provided on the first and second speaker unit supporting members 5, 6, are housed in a region surrounded by the first and second speaker unit supporting members 5, 6 and the first and second headband members 3, 4, as shown in FIG. 16, thus protecting the soft ear support portions.

What is claimed is:

1. A headphone device comprising:

first and second head band members;

a first fulcrum portion for pivotally supporting upper ends of said first and said second head band members so that lower ends of said first and said second head band members are moved towards and away from each other;

first and second speaker unit supporting members carrying first and said second speaker units, said first and second head band members and said first and second speaker unit supporting members forming a continuous curve for surrounding a rear head portion of a user;

second and third fulcrum portions for pivotally supporting ends of said first and said second speaker unit supporting members for rotation towards said lower ends of said first and said second head band members, said second and said third fulcrum portions having center axes of rotation extending in a direction substantially perpendicular to a center axis of rotation of said first fulcrum portion; and ear support portions provided on said first and said second speaker unit supporting members and retained between the user's head and auricles of the user when the user attaches said headphone device to the user's head and said continuous curve surrounds a rear portion of the user's head, wherein said first and second speaker unit supporting members include curved portions having digital ends secured to said first and second speaker units and being located on sound radiating sides of said first and second speaker units.

2. The headphone device according to claim 1 wherein said first and said second speaker units are supported at rear sides thereof opposite to said sound radiating surfaces thereof by said first and said second speaker unit supporting members.

3. The headphone device according to claim 1 wherein said supporting portions are elastic at least on said outer peripheral surfaces thereof.

4. The headphone device according to claim 1 wherein said first and said second speaker unit supporting members are provided with ear support portions formed by soft elastic members retained between the user's head and the user's auricles when the user attaches headphone device to said the user's head.

* * * * *